United States Patent [19]

Suzuki et al.

[11] Patent Number: 4,992,766

[45] Date of Patent: Feb. 12, 1991

[54] LINEAR ACTUATOR

[75] Inventors: Hidemi Suzuki; Horiyuki Yamada; Mikio Nakagawa, all of Saitama, Japan

[73] Assignee: Honda Giken Kogyo Kabushiki Kaisha, Tokyo, Japan

[21] Appl. No.: 377,345

[22] Filed: Jul. 10, 1989

[30] Foreign Application Priority Data

| | | | |
|---|---|---|---|
| Jul. 25, 1988 | [JP] | Japan | 63-97291[U] |
| Jul. 25, 1988 | [JP] | Japan | 63-97292[U] |
| Jul. 25, 1988 | [JP] | Japan | 63-97293[U] |
| Jul. 25, 1988 | [JP] | Japan | 63-97294[U] |
| Jul. 25, 1988 | [JP] | Japan | 63-97295[U] |

[51] Int. Cl.[5] ..... H01F 7/08

[52] U.S. Cl. ..... 335/223; 335/223

[58] Field of Search ..... 335/222, 223, 229, 230, 335/231

[56] References Cited

U.S. PATENT DOCUMENTS

| | | | |
|---|---|---|---|
| 4,649,359 | 3/1987 | Doki et al. | 335/222 |
| 4,703,297 | 10/1987 | Nagasaka et al. | 335/222 |
| 4,808,955 | 2/1989 | Godkin et al. | 335/222 |

FOREIGN PATENT DOCUMENTS

| | | | |
|---|---|---|---|
| 58-63881 | 4/1983 | Japan | 335/222 |

*Primary Examiner*—George Harris

*Attorney, Agent, or Firm*—Pollock, Vande Sande and Priddy

[57] ABSTRACT

In a linear actuator provided with a first projection on a movable part which is linearly driven with the electromagnetic force, so as to engage with one end of a compressing coil spring, and/or a second projection on a stationary part as opposed to the movable part, so as to engage with the other end of the coil spring, and a cup-like washer interposed between said at least one of the projections and said coil spring, a washer is so adapted that said at least one of projections is allowed to collide with the inner bottom part thereof. The linear actuator may comprise a resin film of small friction coefficient interposed between the movable part and the stationary part destined to contact with each other, a thermosensitive resistor which has an opposite resistance-temperature coefficient of the coil and is connected in series to the coil, and/or a means for detecting the relative position of the movable part with respect to the stationary part.

6 Claims, 10 Drawing Sheets

| POSITION OF MAGNET | HALL ELEMENT OUTPUT | | | VALUE |
|---|---|---|---|---|
| | 13a | 13b | 13c | |
| a | H | L | L | $04_H$ |
| b | H | H | L | $03_H$ |
| c | L | H | L | $02_H$ |
| d | L | H | H | $01_H$ |
| e | L | L | H | $00_H$ |

| VALVE OPENING DEGREE | VALUE |
|---|---|
| A | $04_H$ |
| B | $03_H$ |
| C | $02_H$ |
| D | $01_H$ |
| E | $00_H$ |

LINEAR ACTUATOR

BACKGROUND OF THE INVENTION

1. Field of the Invention

This invention relates to a linear actuator for linearly driving an output shaft with electromagnetic force and more particularly to a linear actuator so adapted that the output shaft is enabled to produce a prescribed stroke and stop at a prescribed position stably.

Further, this invention relates to a linear actuator so adapted as to permit accurate detection of the position of the output shaft.

2. Description of the Prior Art

The so-called voice coil type linear actuator has found popular acceptance as an actuator for producing a relatively large stroke such as in open/close control of an exhaust gas recirculation (EGR) valve or an air-conditioning valve in a vehicle.

This actuator comes in two types; one type which is provided with a movable magnet formed integrally with an output shaft and a coil stationarily disposed within the magnetic field of the magnet and the other type which is conversely provided with a stationary magnet and an output shaft formed integrally with a movable coil. The actuator of either type is intended to impart a linear motion to the output shaft by producing a relative motion between the coil and the magnet by virtue of the electromagnetic force which is generated by the interaction between the electric current flowing through the coil and the magnetic field of the magnet.

The output shaft is stopped at the position where the resilient force of a spring disposed so as to exert an action in the direction opposite to the motion of the output shaft and the electromagnetic force are balanced. The stroke of the actuator, therefore, is determined by the magnitude of the electric current flowing through the coil and the resilient force of the spring. The stroke is controlled more often than not by adjusting the magnitude of the electric current flowing through the coil.

What is disclosed in the specification of Japanese Utility Model application Disclosure SHO No. 61-117,588 may be cited as one example of the linear actuators of this class.

An actuator having an output shaft connected with a movable magnet has a cross section illustrated in FIG. 11. The output shaft 1 is inserted into the central part of a cuplike magnet retaining member 2 made of such an electrically insulating material such as resin and joined integrally with the retaining member 2 by the use of a nut 3. To the outer surface of the retaining member 2, a magnet 4 is fastened with an adhesive agent.

A movable part 16 composed of the output shaft 1, the cuplike member 2, and the magnet 4 is adapted to be reciprocated as guided by a bearing 6 inserted in a casing 5 and the outer surface of a cylindrical member 7.

One end of a coil spring 8 engages with a screw member 9 which is put inside the cylindrical member 7 so as to adjust the amount of strain to be imparted in advance to the spring 8, while the other end thereof engages with the bottom part of the magnet retaining member 2. As the result, the resilient force of the coil spring 8 urges the movable part 16 including the retaining member 2 in the direction of the bearing 6. The pressing force or the resilient force generated by the coil spring 8 can be adjusted by moving the screw member 9 forwardly or backwardly in the direction of extension/- contraction of the spring 8 or the axial direction of the output shaft 1.

A coil 12 is disposed in a gap between the casing 5 and the cylindrical member 7. The coil 12 is set in place in the vertical direction by being nipped with retaining plates 10*a* and 10*b* or by molding.

One end of the coil 12 is connected to a lead terminal 14 and the other end thereof (not shown) is connected to the other lead terminal. The lead terminal 14 is fixed in a terminal fitting plate 15 made of an electrically insulating material.

In the actuator constructed as described above, when an electric current is supplied to the coil 12, the electromagnetic force generated by the interaction between the electric current and the magnetic flux of the magnet 4 exerts an action capable of driving the movable part 16 in the direction of compressing the coil spring 8. The spring is compressed as the movable part 16 is moved. The movable part 16 stops at the position where the electromagnetic force and the resilient force of the spring 8 are balanced.

The stroke of the actuator or the stop position of the output shaft 1, therefore, is determined by the magnitude of electric current of the coil 12 and the resilient force of the spring.

The conventional linear actuator described above has entailed the following disadvantage.

The practice of producing a prescribed electromagnetic force by adjusting the electric current flowing through the coil 12 has found general acceptance. In spite of the effort to obtain the prescribed electromagnetic force by the control of the electric current supplied to the coil !2, it is difficult to obtain the prescribed stroke accurately where the resilient force of the spring 8 to be balanced with the electromagnetic force lacks constancy.

It has been customary, therefore, to adjust the resilient force of the spring 8 by moving the screw member 9 in the direction of expansion/contraction of the spring and consequently effecting fine adjustment of the strain (bias) to be preserved in advance in the direction of compression of the spring 8. The problem persists, however, that no fully accurate adjustment of the resilient force is obtained solely by the fine adjustment of the resilient force with the screw member 9.

The resilient force F increases in proportion as the amount of compression x of the spring increases. The relation between the compression x and the resilient force F is expressed by the formula, $$F = K \cdot x + b$$

wherein k stands for the spring modulus and b for the constant depending on the strain given to the spring in advance. While the constant b can be adjusted by the screw member 9, the spring modulus is a constant peculiar to the spring and cannot be adjusted.

When a spring possessing an end face not perpendicular to the center line thereof is compressed, the compression does not produce the designed resilient force in conformity with the spring's inherent spring modulus as mentioned below.

FIG. 12 A is a diagram illustrating the shape of the end face of the spring 8 and FIG. 12 B is a diagram showing the relation between the resilient force of the spring 8 and the force actually acting on the screw member 9.

The spring 8 illustrated in FIG. 12 A is in the state free from the compressive force and has the end face thereof not lying perpendicularly to the center line 8*a*. The spring modulus of the spring is k. When the spring 8 is compressed, since the compression exerts an uneven compressive force on the end face of the spring 8 as illustrated in FIG. 12 B , the center line 8*a* of the spring 8 is curved as indicated by the chain line 8*b*. As the result, the resilient force Fa corresponding to the spring modulus k is resolved into the component Fb directed perpendicularly to the end face of the spring 8 and the component Fc directed parallelly to the end face. On the screw member 9 which is held in contact with the end face of the spring 8, only the component Fb is effectively exerted.

Specifically, only the component Fb of the force Fa determined by the inherent spring modulus k is allowed to act as the resilient force on the screw member 9, depending on the angle which the end face of the spring 8 formed relative to the center line. Since the degree of curving of the center line of the spring increases in proportion as the compression force put on the spring 8 increases, the ratio of the component Fb to the force Fa gradually decreases to bring about an apparent decrease in the spring modulus k.

The resilient force acting on the screw member 9, namely the resilient force exerted in the axial direction of the output shaft 1, is affected by the angle which the end face of the spring 8 forms relative to the center line as described above. A variation, if any, in this angle, therefore, results in impairing the constancy of the resilient force in spite of the accuracy with which the electric current supplied to the coil 12 is effected. This fact renders it difficult for the stroke of the output shaft 1 or the position of stop thereof to be controlled accurately.

The prior art further has the following disadvantages.

(1) For the movable part 16 to be effectively driven by virtue of the electromagnetic force, a suitable gap must be kept between the coil 12 and the magnet 4 and the gap is desired to be uniform throughout the entire circumference of the magnet.

The uniformity of the gap between the coil 12 and the magnet 4 may possibly be impaired when the coil 12 is fixed eccentrically within the casing 5 or a large clearance is provided between the bearing 6 and the output shaft 1 or between the magnet retaining member 2 and the guide member 7. In the absence of uniformity of the gap, the electromagnetic force does not uniformly act on the movable part 16 and the movable part 16 receives an unbalanced driving force.

During the sliding relative motion between the guide member 7 and the magnet retaining member 2, for example, an eccentric load is exerted on specific parts and the relative motion between the magnet retaining member 2 and the guide member 7 does not proceed smoothly, possibly with the adverse result that the responses to the start and stop of the supply of electric current to the coil are delayed. A similar disadvantage arises with respect to the sliding motion which the output shaft 1 produces relative to the bearing 6.

(2) When the stroke is to be controlled by the adjustment of the electric current supplied to the coil, the resistance of the coil is varied under the influence of the heat generated by the current itself in the coil and the ambient temperature and the desired magnitude of electric current and the desired electromagnetic force are not obtained by the application of the prescribed voltage to the coil. This fact makes it difficult for the stroke of the actuator and the position of stop thereof to be stabilized.

(3) The electromagnetic force is possibly varied by the dispersion of resistance of the coil, the variation in the resistance of the coil owing to the heat generated in the coil by the current therein and the influence of the ambient temperature, or by the dispersion of the magnetic field of the magnet and the variation thereof by aging. Since the electromagnetic force to be produced is varied by the variation of the magnitude of resistance of the coil and or the magnetic flux of the magnet, it is difficult to attain accurate control of the stroke of the actuator and the position of stop thereof.

SUMMARY OF THE INVENTION

This invention is directed to a linear actuator which is provided with a projecting part formed On a movable part linearly driven by virtue of electromagnetic force, so as to be adapted for engagement with one end of a compressing coil spring, and/or another projecting part formed on a stationary part as opposed to the movable part, so as to be in engagement with the other end of the coil spring, and a cup-like washer interposed between said at least one of the projecting parts and the corresponding ends of the compressing coil spring disposed between the stationarY part and the movable part, which linear actuatOr is characterized in that the washer is so adapted that the projecting part is allowed to collide with the inner bottom part thereof.

Owing to the construction described above, the resilient force of the coil spring is exerted through the medium of the cup-like washer on at least one of the projecting parts on the ends Of the mOvable part and the stationary part which projecting part is held in contact with the inner bottom part of the cup-shaped washer As the result, the cup-like washer is inclined about the point of contact between the projecting part and the washer, depending on the angle to be formed between the end face of the spring and the center line thereof and, therefore, it is enabled to transmit accurately to the output shaft the resilient force conforming to the designed inherent spring modulus without being affected by the incline angle of the end face of the spring.

The linear actuator of this invention is further characterized by having a resin film of small friction coefficient interposed in the boundary plane between the movable part and the stationary part destined to contact the movable part during the reciprocation of the movable part and allowing the movable part and the stationary part to produce a relative sliding motion through the medium of the resin film. Since the film is made of a resin of small frictional coefficient, the frictional resistance generated between the movable part and the stationary part is mitigated and the sliding motion of the movable part on the stationary part is allowed to proceed very smoothly.

The linear actuator of this invention is further characterized by being provided with a thermosensitive resistor whose characteristic in the variation of the magnitude of resistance is an exact opposite of that of the coil and having the thermosensitive resistor connected in series to the coil and disposed close to the coil. Since the thermosensitive resistor is installed in the proximity of the coil, the temperature thereof is varied proportionately to the variation of the temperature of the coil, and the magnitude of the resultant resistance of the serially connected coil and thermosensitive resistor and the magnitude of the electric current flowing through the coil are retained at substantially constant levels in spite of the variation of temperature. The electromagnetic force which is determined by the electric current of the coil and the magnetic flux of the magnet is retained at a constant level. By conferring a temperature characteristic on the magnitude of resultant resistance of the coil and the thermosensitive resistor in conformity to the temperature characteristic of the magnetic flux of the magnet, the temperature characteristic of the electromagnetic force can be stabilized all the more.

The linear actuator of the present invention is also characterized by being provided with a resistor formed on either of the actuator proper and the output shaft and a contacting slider adapted to slide on the resistor in consequence of the reciprocation of the output shaft. When the output shaft is reciprocated, a variation in the magnitude of resistance between one end of the resistor and the contacting element point of the slider is induced. The position of the slider relative to the resistor, namely the position of the output shaft relative to the actuator proper, therefore, can be detected on the basis of the magnitude of resistance.

The linear actuator of this invention is further characterized by being provided with a plurality of magnetoelectric conversion elements disposed on a line parallel to the direction of reciprocation of the movable magnet. In the construction described above the voltage fed out by the magnetoelectric conversion elements increases in proportion as the distance between the movable magnet and the magnetoelectric conversion elements decreases. On the basis of the levels of voltage severally fed out of the plurality of magnetoelectric conversion elements, therefore, the positional relation between the magnetoelectric conversion elements and the movable magnet can be detected.

Since the position of the output shaft relative to the actuator property can be detected as described above, it can be judged on the basis of the results of said detection whether or not the actual position of the output shaft coincides with the prescribed position. When the position of the output shaft is consequently found to deviate from the prescribed position, the correction needed can be easily made by the feedback control.

DETAILED DESCRIPTION OF THE PREFERRED EMBODIMENTS

Figure 1:
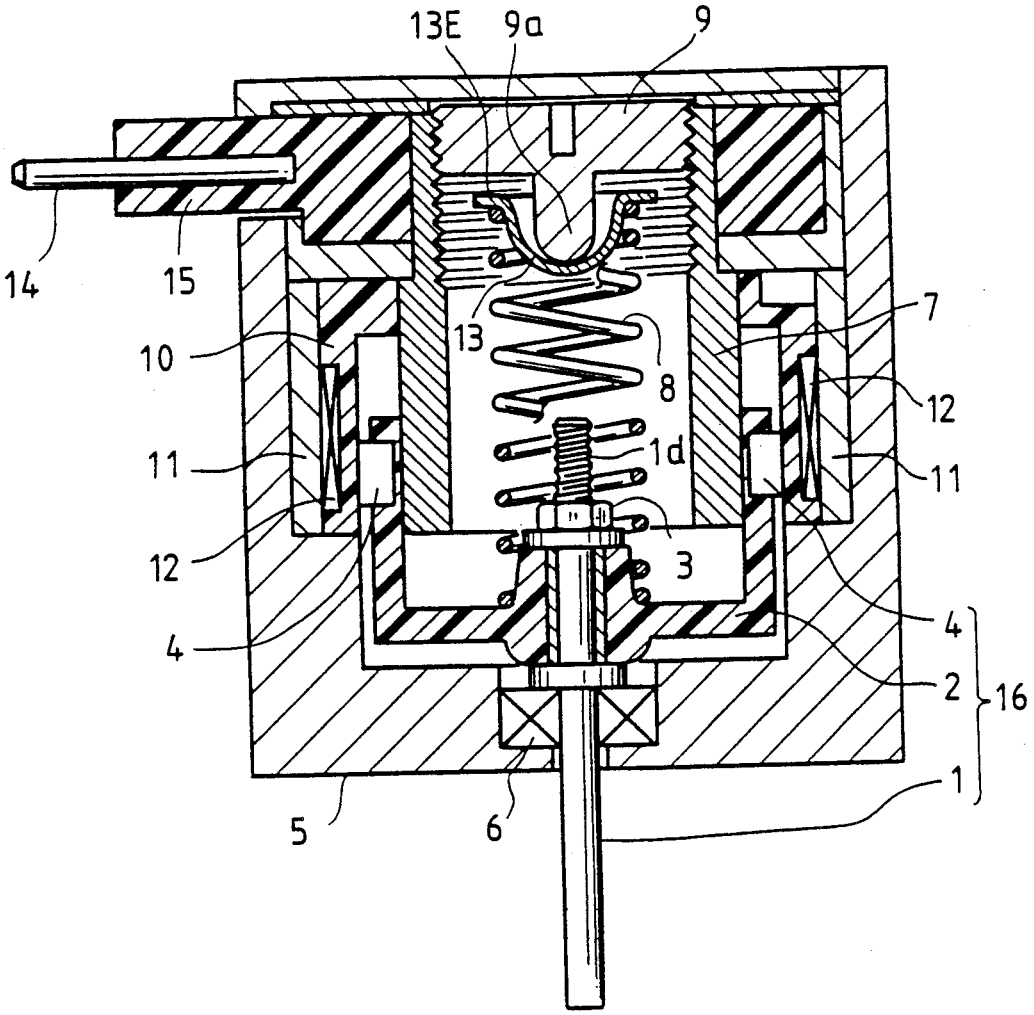
FIGS. 1 to 3, FIG. 6, and FIG. 8 are cross sections illustrating embodiments of the present invention, respectively.

FIG. 1 is a cross section illustrating the first embodiment of this invention. In the diagram, the reference numerals which are the same as those in FIG. 11, already described, denote identical or equivalent parts.

As illustrated in the diagram, the bobbin 10 made of an electrically insulating material is disposed between the casing 5 and the cylindrical (guide) member 7 as nipped between a spacer 11 and the cylindrical member 7. The coil 12 is wound along a groove incised in the outer periphery of the bobbin 10.

The screw member 9 for adjusting the strain imparted in advance in the direction of compression of the spring 8 is provided in the central part thereof with the projecting part **9*a*. The projecting part 9*a* collides with the inner bottom part of a cup-like washer 13, while one end face of the spring 8 collides with a flange part 13E on the outer surface of the opening of the cup-like washer 13**.

When the linear actuator is put to operation by starting the supply of electric current to the coil 12 and consequently driving the output shaft 1, the spring 8 is compressed. When the end face is not perpendicular to the center line of the spring 8, the resilient force of the spring 8 generated in consequence of the compression causes the washer 13 to be inclined with the apex of the projecting part **9*a*** as the fulcrum.

Even when the end face of the spring 8 is not perpendicular to the center line of the spring 8, therefore, the center line of the spring 8 is allowed to coincide with the axis of the output shaft 1. The resilient force of the spring 8, therefore, always acts concentrically in the axial direction of the output shaft 1.

The interposition of the cup-like washer 13 between the one end of the spring 8 and the projecting part **9*a* of the screw member 9 as in the FIG. 1 embodiment is not critical. It is permissible for a similar washer to be interposed between the lower end of the spring 8 and the leading end of the screw part 1*d* of the output shaft 1, for example. Otherwise, similar washers may be interposed one each between the one end of the spring and the projecting part 9*a* and between the other end of the spring and the leading end of the screw part 1*d***.

In accordance with the present embodiment, since the axial line of the spring 8 can be always coincide with the center line of the output shaft 1, the resilient force accurately conforming to the spring modulus of the spring can be effectively exerted on the output shaft 1 and the stroke of the output shaft can be accurately controlled.

Figure 2:
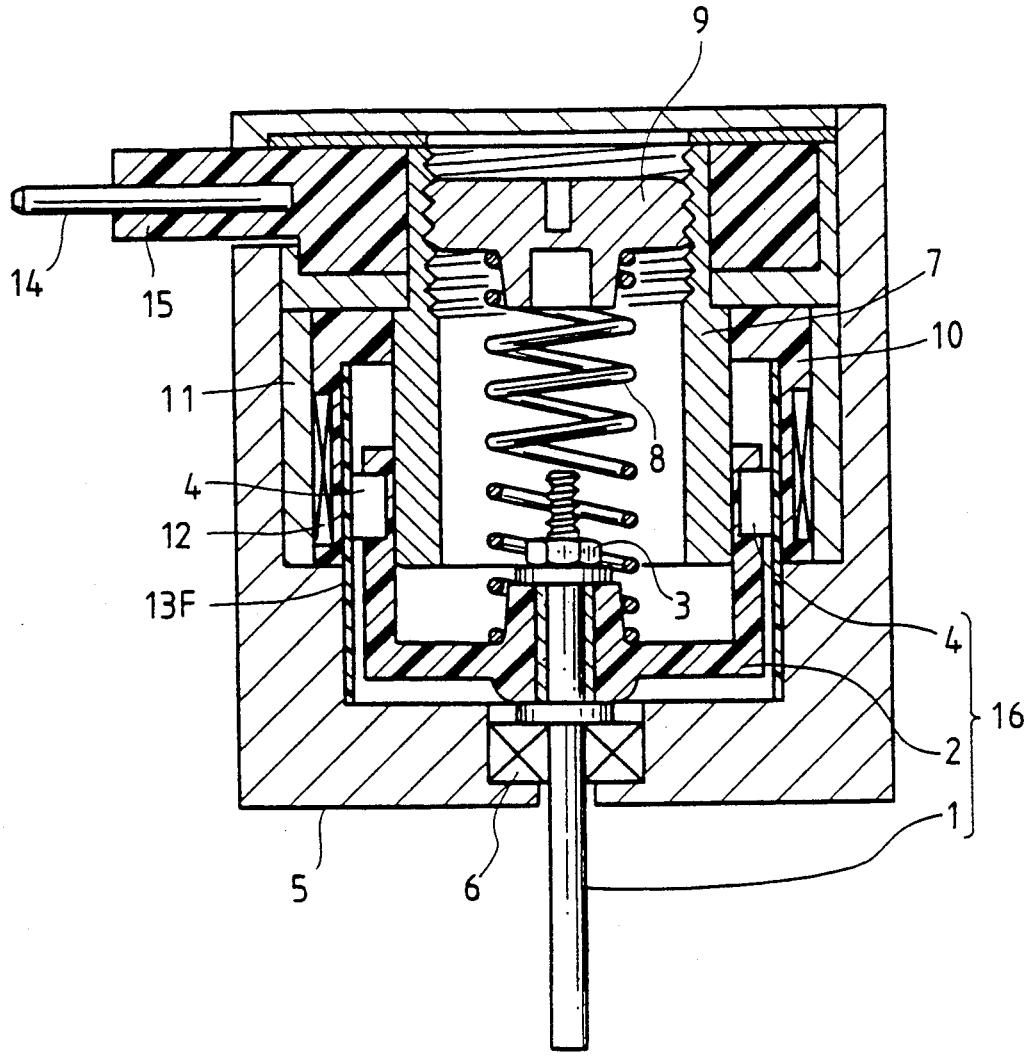

FIG. 2 is a cross section illustrating the second embodiment of this invention. In the diagram, the reference numerals which have equals in FIG. 1 denote identical or equivalent parts. As illustrated in the diagram, polyimide resin film 13F of small frictional resistance is interposed between the bobbin 10 and the magnet 4. The movable part 16 is reciprocated by the magnet being guided with the bobbin 10 through the medium of the polyimide resin film 13F and the output shaft 1 being guided with the bearing 6.

When the electric current is supplied to the coil 12, the movable part 16 is driven in the direction of compressing the spring 8. When the supply of the electric current is stopped, the movable part 16 is returned to its original position by the resilient force of the spring 8. The reciprocating motion of the movable part 16 is carried out while the magnet 4 is retained in contact with the polyimide resin film 13F. Even when the magnet 4 is pressed quite strongly against the resin film 13F, since the frictional resistance of the resin film is small, the magnet 4 is allowed to slide easily without experiencing any appreciable resistance and the movable part 16 is consequently reciprocated smoothly.

Even when the magnet retaining member 2 and the guide member 7 are opposed to each other across an intervening gap, the movable part 16 is allowed to produce a smooth reciprocating motion because the magnet 4 is mainly reciprocated as guided by the inner surface of the bobbin 10 through the medium of the resin film 13F.

Since the magnet 4 is reciprocated as held in contact with and guided by the resin film 13F, the gap between the coil 12 and the magnet 4 can be retained at the constant value to be determined by the wall thickness of the bobbin 10 and the thickness of the resin film 13F even when the coil 12 is fixed in eccentric.

In the embodiment of FIG. 2, the resin film 13F is depicted as possessing a shape and dimensions such that it will wholly cover the inner surface of the bobbin 10 and the inner surface of the casing 5 and will consequently be fixed stably within the casing 5. For the present invention, the film 13F is only required to cover the portion of the inner surface of the bobbin 10 on which the magnet 4 slides. The film 13F is not limited to the position indicated in FIG. 2. Instead of this position, it may be disposed between the magnet retaining member 2 and the cylindrical guide member 7. Optionally, it may be disposed at the two positions mentioned above.

Figure 11:
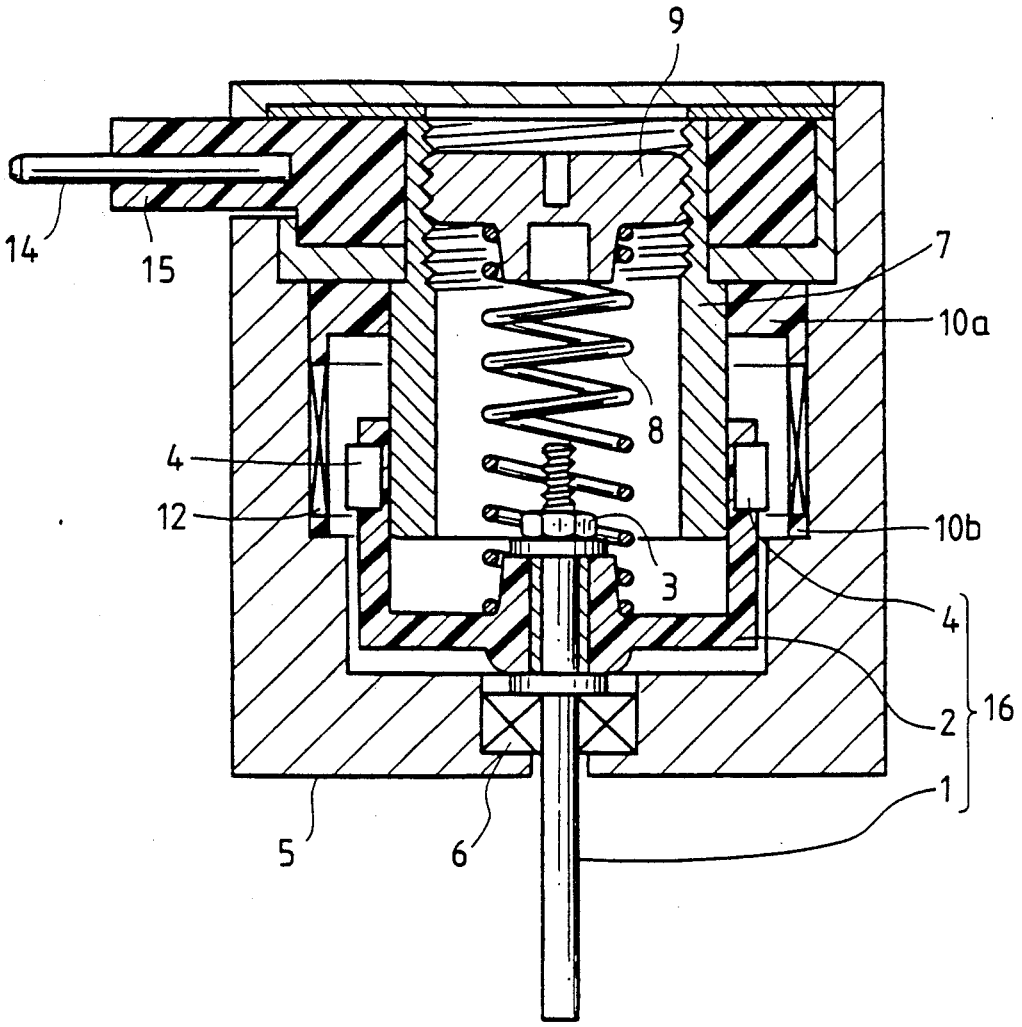
FIG. 11 PRIOR ART
FIG. 11 is a cross section of the conventional linear actuator.

Further, the FIG. 2 embodiment is depicted as having the barrel part of the bobbin 10 interposed between the coil 12 and the resin film 13F. This particular interposition is not critical. Optionally, the upper end of the coil 12 may be fixed as nipped between retaining plates and the resin film 13F disposed so as to contact the inner peripheral surface of the coil 12 as illustrated in FIG. 11.

The resin film 13F is not limited only to the polyimide resin. Any other resin may be used as the material for the resin film on the condition that the resin should possess small frictional resistance. The resin film 13F made of carbon fluoride resin, for example, is used as effectively in the FIG. 2 embodiment as the polyimide resin film.

In the FIG. 2 embodiment, an actuator in which a coil adapted for reciprocation is integrally formed with an output shaft can be used as effectively as the actuator having the movable magnet formed integrally with the output shaft.

In accordance with the FIG. 2 embodiment, since the sliding resistance between the movable part and the stationary part is mitigated, the movable part can be smoothly moved even with an eccentric driving force. As the result, delay in the response of the movable part to the start and stop of the electric current to the coil is eliminated.

Figure 3:
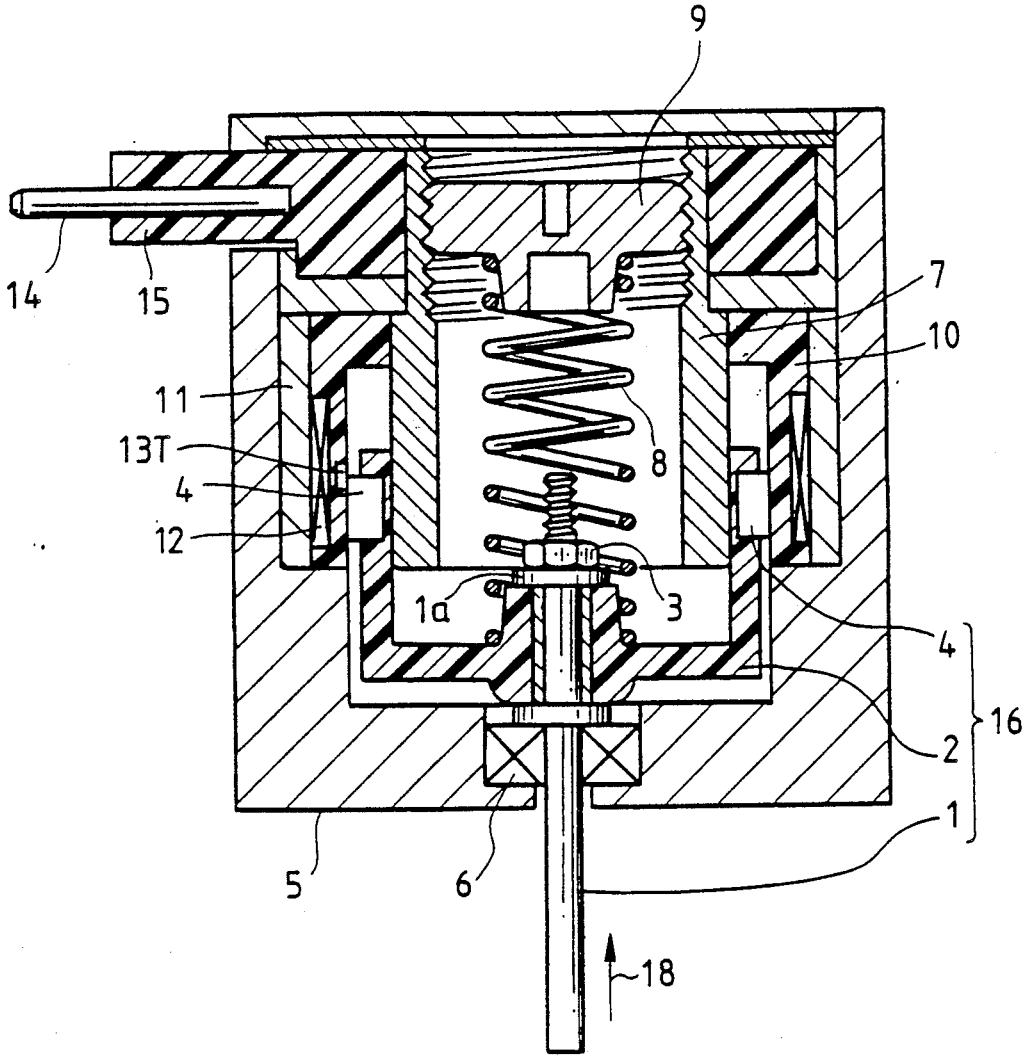

FIG. 3 is a cross section illustrating the third embodiment of this invention. In the diagram, the reference numerals which have equals in FIG. 2 denote identical or equivalent parts.

In the portion intervening between the casing 5 and the cylindrical guide member 7, the bobbin 10 made of an electrically insulating material and having the coil 12 wound thereon is disposed as nipped between the cylindrical member 7 and the spacer 11 of a high-permeability material which is so as to contact the inner peripheral surface of the casing 5.

Under the inner surface of the bobbin 10, a thermosensitive resistor 13T connected in series to the coil 12 is buried adjacent to the coil 12, and the temperature resistance coefficient of the thermosensitive resistor 13T has a temperature characteristic opposite to that of the resistance of the coil 12. In the FIG. 3 embodiment, the thermosensitive resistor is desired to be a thermistor capable of decreasing the magnitude of resistance in accordance as the temperature rises. The coil 12 and the thermistor 13T are connected in series between the lead terminal 14 and another lead terminal (not shown).

When the electric current is supplied to the coil 12 and the thermistor 13T to drive the linear actuator, the electromagnetic force produced by the interaction between the electric current and the magnetic field of the magnet 4 drives the magnet 4 and consequently the movable part 16 in the direction of the arrow 18. When the supply of the electric current to the coil 12 is stopped, the magnet retaining member 2 is returned by the resilient force of the coil spring 8 to the illustrated position at which the flange part 1*a* of the output shaft 1 comes into contact with the bearing 6.

Figure 4:
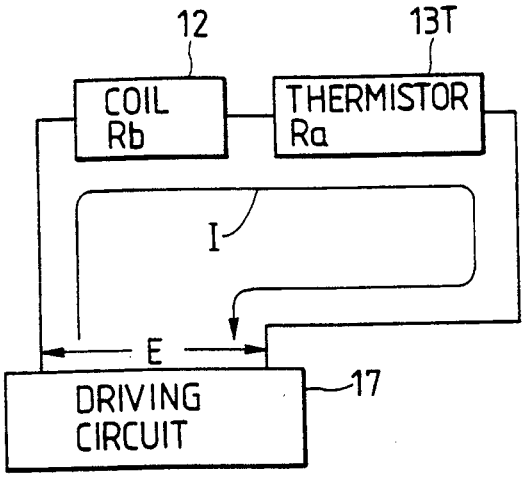
FIG. 4 illustrates a driving circuit for the embodiment of FIG. 3.
Figure 5:
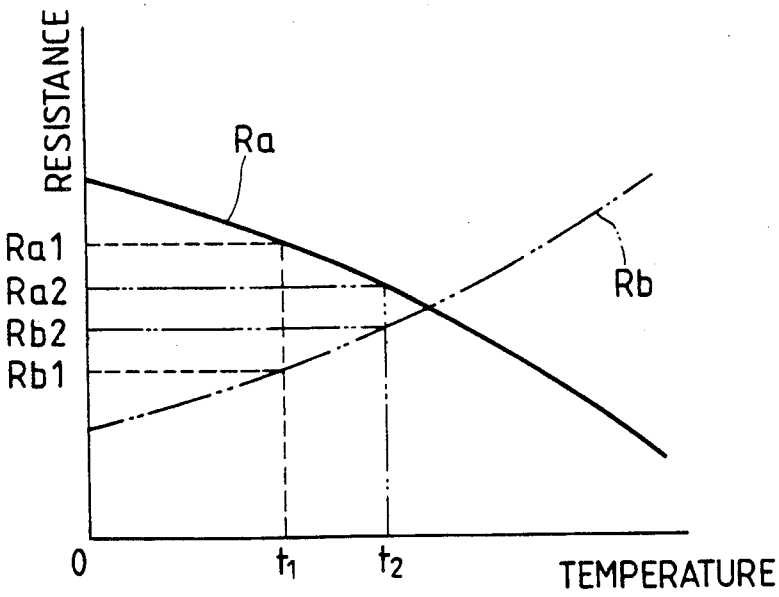
FIG. 5 shows temperature characteristics of resistance of a coil and a thermistor used advantageously for the embodiment of FIG. 3.

FIG. 4 is a diagram illustrating the driving circuit 17 and the circuits for the coil 12 and the thermistor 13T, and FIG. 5 is a diagram illustrating the temperature characteristics of the coil 12 and the thermistor 13T used in the FIG. 3 embodiment.

The electric current, I, which flows through the driving circuit 17, the coil 12, and the thermistor 13T is expressed by the formula $I=E/(Ra+Rb)$, wherein E stands for the output voltage of the driving circuit 17, Rb for the magnitude of resistance of the coil 12, Ra for the magnitude of resistance of the thermistor 13T, and I for the electric current as illustrated in FIG. 4. In the diagram of FIG. 5, the horizontal axis represents the temperature of the coil 12 and the thermistor 13T and the vertical axis represents the scale of the magnitude of resistance thereof. The magnitudes of resistance, Ra and Rb, are varied when the supply of the electric current to the coil 12 and the thermistor 13T is continued for a long time or the ambient temperature thereof is varied.

As shown in FIG. 5, the coil 12 possesses a positive characteristic of increasing the magnitude of resistance thereof in proportion as the temperature thereof rises and the thermistor 13T possesses a negative characteristic of decreasing the magnitude of resistance thereof in proportion as the temperature thereof rises. When the temperature of the coil 12 and the thermistor 13T rises from $t_1$ to $t_2$, for example, the magnitude of resistance, Rb, of the coil 12 increases from Rb1 to Rb2 and the magnitude of resistance, Ra, of the thermistor 13T conversely decreases from Ral to Ra2. Substantially no change is found between the magnitudes of resultant resistance of (Ra1+Rb1) and (Ra2+Rb2) of the coil 12 and the thermistor 13T which are connected in series.

So long as the applied voltage E is not varied, therefore, the electric current I supplied to the coil 12 is retained at a constant level and the electromagnetic force for driving the output shaft 1 is similarly retained at a constant level. The stroke and the position of stop of the output shaft 1 which is driven by the electromagnetic force, therefore, are stabilized.

In the FIG. 3 embodiment, the increment of variation in the magnitude of resistance of the coil 12 owing to the variation of temperature can be offset with the increment of variation in the magnitude of resistance of the thermistor which is connected in series to the coil 12. The electric current which flows to the coil 12, therefore, can be retained substantially at the prescribed level without being affected by the variation of temperature of the coil 12 and the ambient air thereof and the operating position of the output shaft 1 can be accurately controlled.

The FIG. 3 embodiment has been described as one that uses as the thermosensitive resistor a thermistor which possesses a negative characteristic relative to the rise of the temperature. The use of the thermistor is not critical. Any thermosensitive resistor can be employed effectively in the FIG. 3 embodiment so long as it possesses a characteristic opposite to the temperature characteristic of the resistance of the coil 12.

Figure 6:
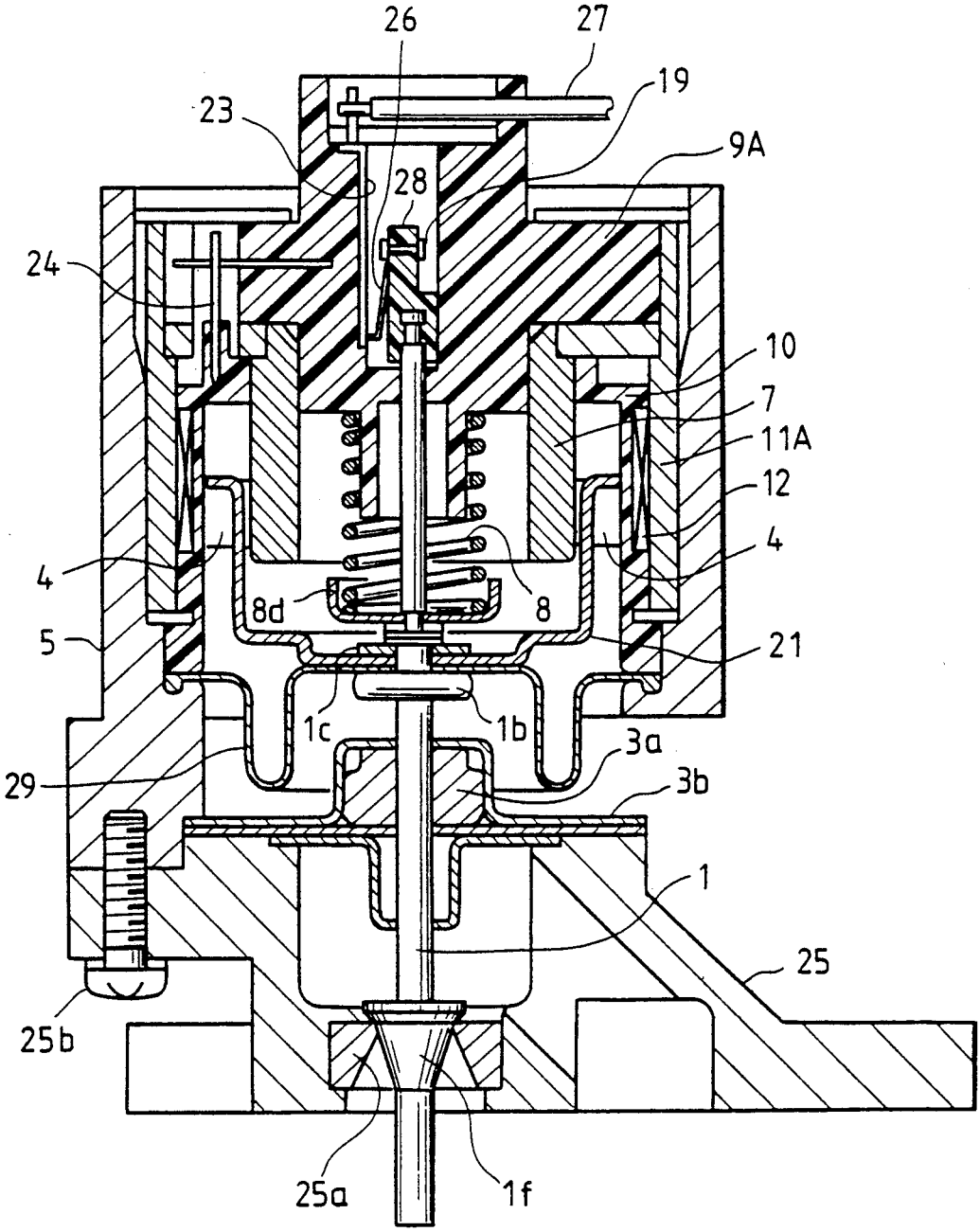

FIG. 6 is a cross section illustrating the fourth embodiment of the present invention. This embodiment represents a case wherein the exhaust gas recirculation valve of an automobile engine connected to the output shaft of the linear actuator is opened or closed by the reciprocation of the output shaft for the control of the amount of the exhaust gas recirculation (EGR). In this diagram, the reference numerals which have equals in FIG. 1 denote equivalent parts.

A base 25 and the cylindrical casing 5 of the actuator are joined with a bolt 25*b*. Inside the casing 5, a cylindrical spacer 11A is disposed as held in contact with the inner wall of the casing 5 and the bobbin 10 having the coil 12 wound thereon is disposed contiguously to the inner wall of the spacer 11. A bearing member 9A made of an electrically insulating material is inserted along the inner wall of the guide member 7. The spacer 11A is desired to be made of a high-permeability material.

In the central part of the casing 5 is disposed the output shaft 1. The output shaft 1 is supported in place so as to be reciprocated by the bearing member 9A and the bushing 3*a* which is encircled with a metal piece 3*b* fixed on the base 25. The output shaft 1 is coaxially inserted into the central part of the cup-like member 21 and the cup-like member 21 is fixed through the medium of a bellows 29 to the output shaft 1 with the flange part 1*b* and the washer 1*c*. The magnet 4 is attached to the outer periphery of the cup-like member 21.

The upper end of the coil spring 8 is held in contact with the bearing member 9A and the lower end thereof is held in contact with the bottom part of the cup-like member 2 through the medium of the washer 8*d*. Thus, the coil spring 8 presses the cup-like member 21 in the direction of the flange part 1*b* of the output shaft 1.

The valve 1*f* which opens or closes the path for the exhaust gas is connected to the lower end of the output shaft and an insulating block 28 is attached to the upper end of the output shaft 1. To the insulating block 28, a sliding element 26 made of a conductive material is fastened with the pin 19. The sliding element 26 is held in contact with the resistor 23 fixed to the inner surface of the bearing member 9A and is allowed to slide on the resistor 23 in consequence of the motion of the output shaft 1 in the axial direction. The resistor 23 is connected with a lead wire 27 to the control device (FIG. 7) and the sliding element 26 is connected with a lead wire (not shown) to the control device through the pin 19.

The output shaft 1, the cup-like member 21, the magnet 4, etc. (hereinafter collectively referred to as "movable part") can be reciprocated in the axial direction of the output shaft 1 as guided by the outer peripheral surface of the cylindrical guide member 7 and the inner peripheral surface of the bobbin 10.

The lead terminal 24 is connected with a lead wire (not shown) to one end of the coil 12 and the other end of the coil 12 is connected to the other lead terminal (not shown).

When the electric current flows through the lead terminal 24 to the coil 12 to start the linear actuator, the electromagnetic force generated by the interaction between the electric current and the magnetic flux of the magnet 4 drives the magnet 4 in the direction of compressing the coil spring 8. As the result, the cup-like member 21 and the output shaft integrated with the magnet 4 are driven in the same direction.

The motion of the movable part by the electromagnetic force is restricted by the resilient force of the coil spring 8 which is exerted in the direction opposite to the direction of the motion. The movable part is stopped at the position at which the electromagnetic force for driving the movable part and the resilient force of the coil spring 8 are balanced. When the supply of the electric current to the coil 12 is stopped, the resilient force of the coil spring 8 urges the output shaft 1 downward to return it to the position at which the valve 1*f* collides with the valve seat 25*a* and the path for the exhaust gas is closed. The position of stop of the movable part is detected on the basis of the position of contact of the sliding element 26 with the resistor 23.

Figure 7:
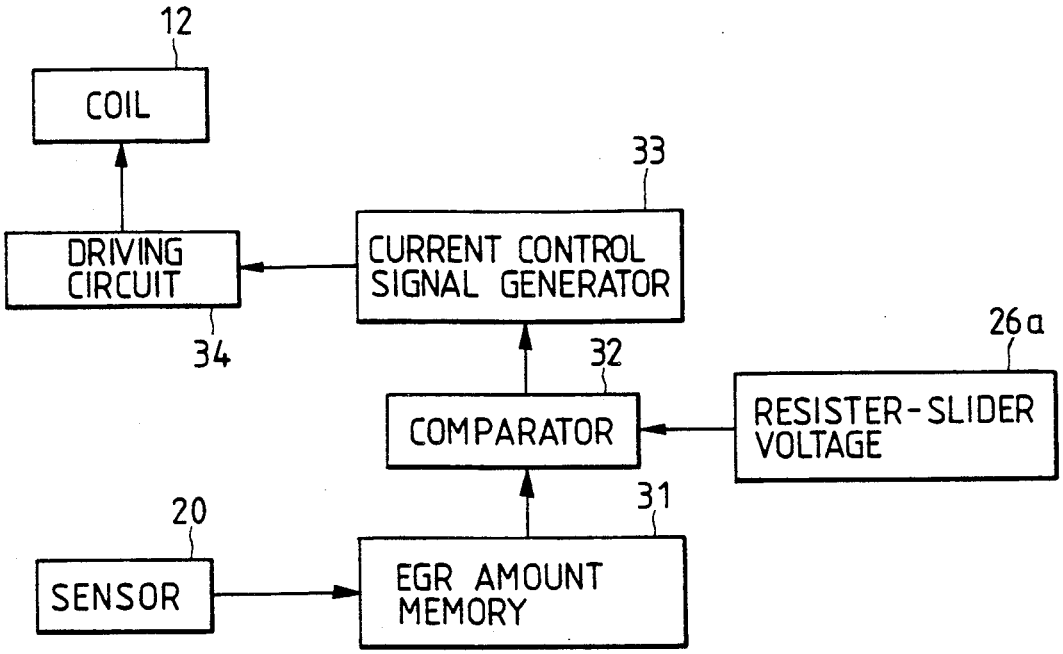
FIG. 7 is a block diagram of a control device adapted for use with the embodiment of FIG. 6.
Figure 12A:
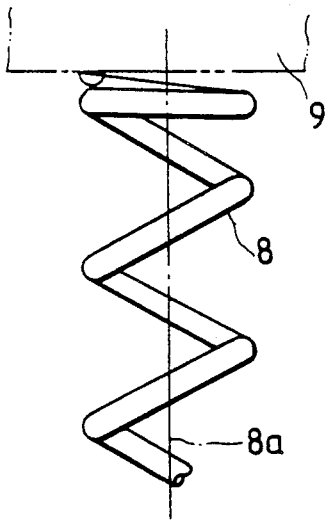
FIG. 12 is a diagram showing the relation between the shape of cross section of the spring and the resilient force of the spring.
Figure 12B:
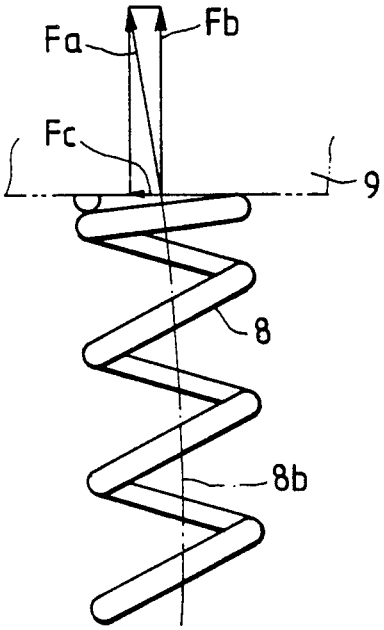

Now, the control device for controlling the amount of EGR by the control of the position of motion of the exhaust gas recirculation valve will be described. FIG. 7 is a block diagram illustrating the control device for the position of the valve 1*f*.

The position control device controls the position of the output shaft 1 of the actuator in accordance with, the outcome of the detection of the sensor 20 and adjusts the gap between the valve seat 25*a* and the valve 1*f* interlocked with the output shaft 1. The sensor 20 is a sensor for detecting the angle of rotation of the distributor, a sensor for detecting the amount of intake air, a sensor for detecting the temperature of suction air, or a sensor for detecting the water temperature, whichever is capable of issuing information necessary for the determination of the amount of EGR.

As illustrated in FIG. 7, the electric current is supplied by the driving circuit 34 to the coil 12. The electric current so supplied is increased or decreased in response to the signal from an electric current control signal generating part 33. The judgment as to whether the electric current control signal generating part 33 issues a signal for increasing the electric current supplied to the coil or a signal for decreasing the electric current is effected as follows.

The condition of an engine at the present time is detected on the basis of the output from the sensor 20. The optimum amount of EGR corresponding to the outcome of the detection is read out of the ERG amount memory part 31, converted into the target position of the recirculation valve 1*f*, and injected into a comparison part 32. On the other hand, the detected voltage 26*a* between one end of the resistor 23 and the sliding element 26 is injected into the comparison part 32. The comparison part compares the voltage with the value read out of the EGR amount memory part 31.

The comparison determines the deviation of the sliding element 26 (the current position of the recirculation valve) from the target position of the recirculation valve 1*f*.

The deviation obtained in the comparison part 32 is fed out to the electric current control signal generating part 33. The electric current control signal generating part 33 issues, based on the magnitude and polarity of the deviation, to the driving circuit 34 either the signal for increasing or decreasing the electric current to be supplied to the coil 12. When the deviation is "0," neither of the signals for increasing and decreasing the electric current is issued.

The driving circuit 34 increases or decreases the electric current supplied to the coil 12, depending on the electric current control signal. The position of the magnet 4 is changed as the electric current fed to the coil 12 is increased or decreased. When the position of the magnet 4 is changed, the position of the exhaust gas recirculation valve 1*f* is changed to give rise to a desired opening of the valve to the valve seat.

The EGR amount memory part 31, the comparison part 32, and the electric current control signal generating part 33 may be each composed of a microcomputer.

In the present embodiment, the position of the sliding element 26 relative to the resistor 23, namely the degree of opening of the valve 1*f*, can be detected on the basis of the voltage between one end of the resistor 23 and the sliding element 26. Where the position of the valve 1*f* deviates from the target position read out based on the outcome of detection of the sensor 20, the position of the magnet 4, namely, the position of the valve 1*f*, can be adjusted by increasing or decreasing the electric current supplied to the coil 12.

The present embodiment represents a case wherein the sliding element is attached on the output shaft side and the resistor 23 is fixed on the actuator proper side. Optionally, the sliding element 26 may be fixed on the actuator proper and the resistor 23 may be fixed on the output shaft side. What is critical is that the sliding, element 26 and the resistor 23 should be so arranged that their relative positions will be varied in consequence of the reciprocating motion of the output shaft.

The present embodiment is not limited to the driving of the exhaust gas recirculation valve. It may be utilized in any of the actuators illustrated in FIGS. 1 to 3 or employed for driving various control mechanisms.

In accordance with the present embodiment, there can be provided an actuator which adjusts the magnitude of electric current to the coil by feeding back the current position of the movable part to the control device and permits accurate control of the stroke of the output shaft even when the magnitude of resistance of the coil is dispersed or the magnitude of resistance of the coil is varied and the electric current flowing to the coil is varied under the influence of the heat generated by the coil or the heat of the ambient air.

Figure 8:
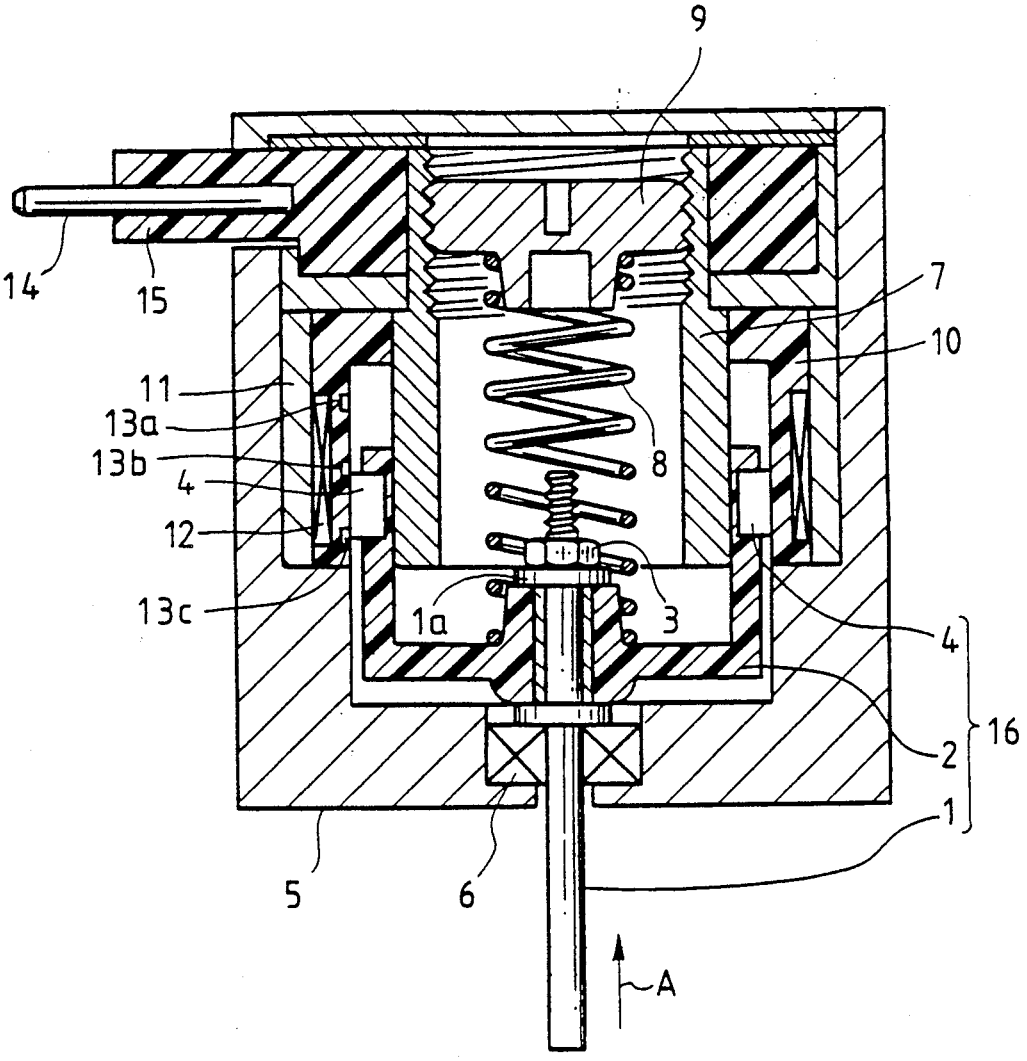

FIG. 8 is a cross section illustrating the fifth embodiment of the present invention. In the diagram the reference numerals which have equals in FIGS. 1 to 3 denote equivalent parts.

By 13*a*, 13*b*, and 13*c* are denoted magnetoelectric conversion elements buried under the inner surface of the bobbin 10 as separated by prescribed intervals parallelly to the course of the reciprocating motion of the magnet. In the present embodiment, Hall elements are used as the magnetoelectric, conversion elements.

The Hall elements 13*a* to 13*c* generate output voltage conforming to the magnitude of magnetic field produced by the magnet 4. By comparing the output voltages and the reference voltage, therefore, the relative positions of the Hall elements 13*a* to 13*c* to the magnet 4, namely the position of the output shaft 1, can be detected.

Figure 9:
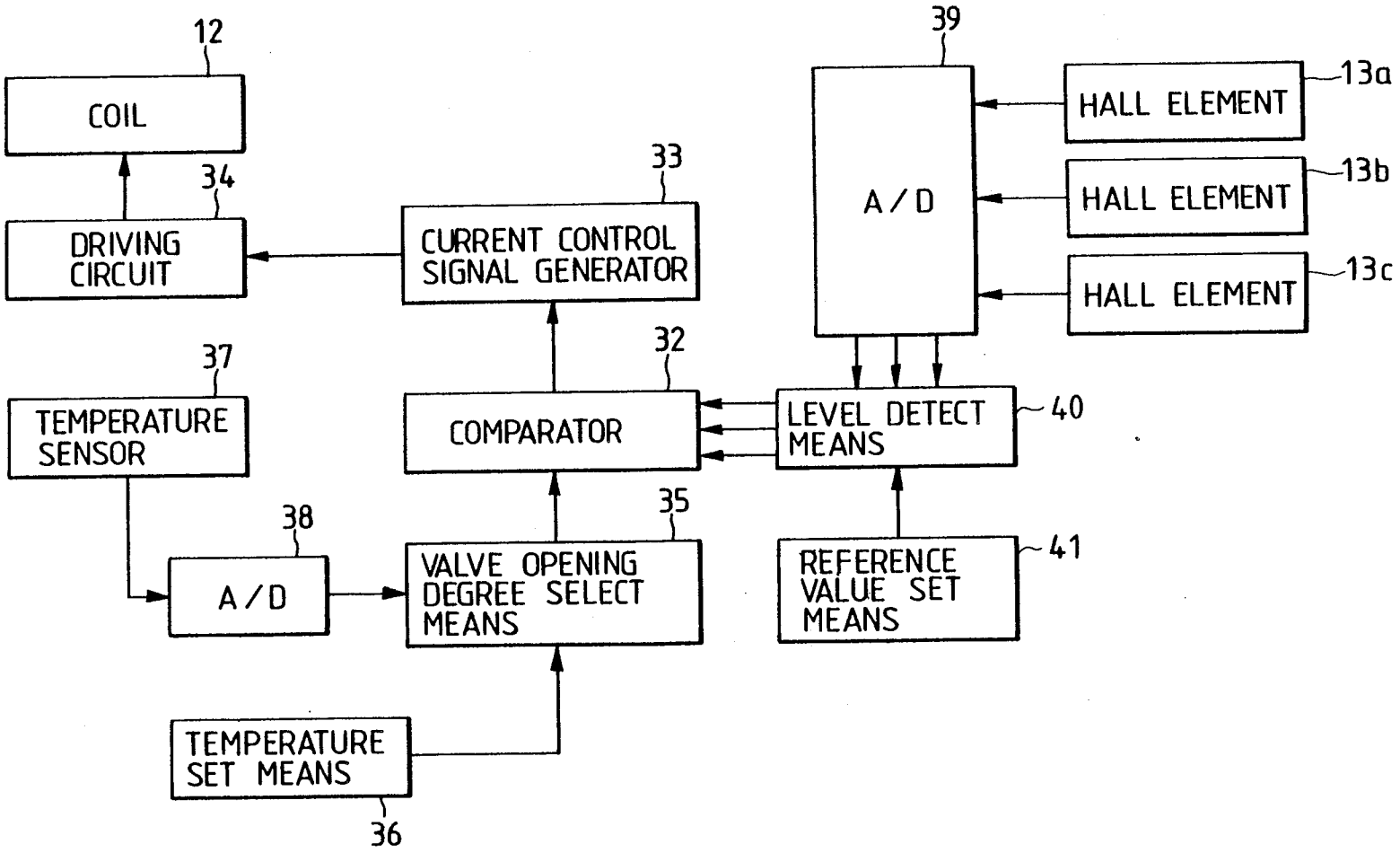
FIG. 9 is a block diagram of a control device advantageous for use with the embodiment of FIG. 8.

Now, the position control device for the output shaft 1 will be described. FIG. 9 is a block diagram illustrating the position control device using the actuator for the purpose of opening and closing an air-conditioning valve. The position control device controls the position of the output shaft 1 of the actuator in accordance with the outcome of the detection made by a temperature sensor 37 and adjusts the degree of opening of the valve (not shown) interlocked with the output shaft 1.

The electric current fed to the coil 12 through the driving circuit 34 is increased or decreased in response to the signal from the electric current control signal generating part 33. The signal of the current temperature detected by the temperature sensor 37 is given A/D conversion by an A/D converter 38 and then injected into a valve opening degree selecting means 35. In the valve opening degree selecting means 35, the current temperature mentioned above is compared with the prescribed temperature set in a temperature setting part 36. Based on the difference between the two temperatures, one of the degrees of valve opening, A to E, which will be specifically discussed hereinafter with reference to FIG. 10 C , is selected. The degree of valve opening thus selected is converted into a signal indicative of the degree of opening and injected into the comparison means 32.

The output voltages from the Hall elements 13*a* to 13*c* are given A/D conversion in an A/D converter 39 and injected into a level detecting part 40. In the level detecting part 40, the magnitudes of the output voltages of the Hall elements 13*a* to 13*c* issued from the A/D converter 39 are each compared with the magnitude of voltage set in a reference value setting part 41. The results of the comparison are fed out to the comparison means 32.

When the magnitudes of the output voltages of the Hall elements 13*a* to 13*c* are larger than the magnitude of voltage set in the reference value setting part 41, the level detecting part 40 issues a high level signal "H." When the magnitudes of the output voltages of the Hall elements 13*a* to 13*c* are smaller than the magnitude of voltage set in the reference value setting part 41, a low level signal "L" is issued.

The position of the magnet 4 or the position of the output shaft 1 and consequently the degree of opening of the air-conditioning valve can be detected on the basis of the combination of the output levels "H" or "L" issued from the level detecting part 40 with reference to the Hall elements 13*a* to 13*c*.

In the comparison means 32, the position of the output shaft 1 expressed by the combination of "H" or "L" is compared with the signal issued from the valve opening degree selecting means 35. The result of this comparison is fed out to the electric current control signal generating part 33. As the result, the electric current control signal generating part 33 feeds out to the driving circuit 34 a signal for increasing or decreasing the electric current supplied to the coil 12 so as to cancel the difference between the target degree of valve opening and the current degree of valve opening. The electric current is increased or decreased gradually by fixed increments. The electric current control signal generating part 33 continues to issue the signal until the position of the magnet 4 relative to the the Hall elements 13*a* to 13*c* reaches the target position.

The level detecting part 40, the reference value setting part 41, the comparison means 32, the electric current control signal generating part 33, and the valve opening degree selecting means 35 may be each formed of a microcomputer.

Figures 10A, 10B, 10C:
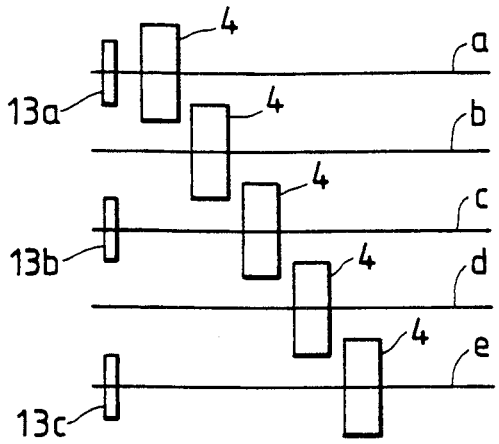
FIG. 10 is a diagram aiding in the explanation of the operation of the embodiment of FIG. 8, with FIG. 10A showing the positional relation of a Hall element and a magnet, FIG. 10B the relation between the position of the magnet and the output of the Hall element, and FIG. 10C the relation between the degree of opening of the valve and the numerical value thereof.

FIG. 10A illustrates the positions of the magnet 4 relative to the Hall elements 13*a* to 13*c* and FIG. 10B shows the output levels of the Hall elements 13*a* to 13*c* when the magnet 4 is located at the varying positions of a to e and the numerical values corresponding to the varying combinations of the output levels. FIG. 10C is a table showing the relation between the degree of valve opening and the numerical value. The tables of correspondence shown in FIGS. 10B and 10C are stored in a memory part (not shown).

The combination of the Hall elements 13*a* to 13*c* indicative of the position of the magnet 4 and the degree of valve opening are converted into numerical values as illustrated in FIGS. 10B and 10C (expressed by the hexadecimal notation herein) (by a conversion means not shown in the diagram) and fed into the comparison means 32.

With reference to FIGS. 10A and 10B, when the magnet 4 is located at the position a, the result of the comparison between the output voltage of the Hall element 13*a* and the reference value is "H" and the results of the comparison, are both "L" in the cases of the Hall element 13*b* and the Hall element 13*c*. The output levels which correspond to the reference values of the Hall elements 13*a* to 13*c* when the magnet 4 is located at the positions b to e are as illustrated in FIGS. 10A and 10B.

In the case where A is selected as the target degree of valve opening and the magnet 4 is located at present at the target position d, for example, the numerical value, $04_H$, corresponding to the degree, A, of valve opening and the numerical value, $01_H$, corresponding to the current position, d, of the magnet 4 are compared in the comparison means 32. In this case, since the numerical value corresponding to the current position, d, of the magnet 4 is smaller than the numerical value corresponding to the target degree, A, of valve opening, the electric current supplied from the driving circuit 34 to the coil 12 is increased and the movement of the magnet 4 is proportionately increased.

In the case where B is selected as the target degree of valve opening and the magnet 4 is located at present at the position a, the numerical value, $03_H$, corresponding to the target degree, B, of valve opening and the numerical value, $04_H$, corresponding to the position, a, of the magnet 4 are compared in the comparison means 32. In this case, since the numerical value corresponding to the present position a of the magnet 4 is larger than the numerical value corresponding to the target degree B of valve opening, the electric current supplied from the driving circuit 34 to the coil is decreased and the movement of the magnet 4 is proportionately decreased.

As described above, the present embodiment permits the position of the magnet 4 to be detected on the basis of the output voltages of the Hall elements 13*a* to 13*c*. When the position of the magnet 4 is different from the target position, the difference is cancelled by increasing or decreasing the electric current supplied to the coil 12. As the result, the electromagnetic force acting on the magnet 4 can be adjusted and the position of the magnet 4 or the position of, the output shaft 1 can be adjusted.

The FIG. 8 embodiment has been described as using three Hall elements. The number of Hall elements need not be limited to 3 but may be changed to others. The number of Hall elements to be disposed at a specific position in the direction of reciprocation of the output shaft 1 is not limited to 1. Optionally, a plurality of Hall elements may be disposed at one and the same position and the outputs thereby may be averaged.

Further, the present invention may be embodied in an actuator in which an output shaft is connected to a coil formed so as to be reciprocated and a magnet is fixed on the actuator proper side, besides the actuator in which the output shaft is connected to the movable magnet as in the present embodiment.

What is claimed is:

1. A linear actuator comprising a magnet, a coil disposed within the magnetic field of said magnet, an output shaft mechanically connected to either of said magnet and said coil and supported by a casing so as to be linearly reciprocated in the axial direction of its own and consequently allowed to form a movable member, and coil spring means fitted between said movable member and a stationary member within said casing so as to resist the electromagnetic force generated by the interaction between the electric current fed to said coil and the magnetic field of said magnet and serving to drive said movable member in one direction of said output shaft, which linear actuator is characterized by being provided with a projecting part formed on at least one of the portions of said movable member and said stationary member which are engaged to the opposite ends of said coil spring and a cup-like washer interposed between the end of said coil spring and said projecting part in such a manner as to allow said projecting part to collide with the inner bottom part thereof.

2. A linear actuator comprising a magnet, a coil disposed within the magnetic field of said magnet, an output shaft mechanically connected to either of said magnet and said coil and supported by a casing so as to be linearly reciprocated in the axial direction of its own and consequently allowed to form a movable member, and coil spring means fitted between said movable member and a stationary member within said casing so as to resist the electromagnetic force generated by the interaction between the electric current fed to said coil and the magnetic field of said magnet and serving to drive said movable member in one direction of said output shaft, which linear actuator is characterized by being provided with a resin film of small friction coefficient disposed on the boundary face of said stationary member with which said movable member sliding contacts when said movable member is reciprocated.

3. A linear actuator according to claim 2, wherein said resin film is fixed on the surface of said stationary member.

4. A linear actuator comprising a magnet, a coil disposed within the magnetic field of said magnet, an output shaft mechanically connected to either of said magnet and said coil and supported by a casing so as to be linearly reciprocated in the axial direction of its own and consequently allowed to form a movable member, and coil spring means fitted between said movable member and a stationary member within said casing so as to resist the electro-magnetic force generated by the interaction between the electric current fed to said coil and the magnetic field of said magnet and serving to drive said movable member in one direction of said output shaft, which linear actuator is characterized by being provided with a thermosensitive, resistor connected in series to said coil and disposed close to said coil and said thermosensitive resistor possessing a temperature characteristic opposite to that of said coil.

5. A linear actuator comprising a magnet, a coil disposed within the magnetic field of said magnet, an output shaft mechanically connected to either of said magnet and said coil and supported by a casing so as to be linearly reciprocated in the axial direction of its own and consequently allowed to form a movable member, and coil spring means fitted between said movable member and a stationary member within said casing so as to resist the electromagnetic force generated by the interaction between the electric current fed to said coil and the magnetic field of said magnet and serving to drive said movable member in one direction of said output shaft, which linear actuator is characterized by being provided with a resistor disposed on either of said stationary member and said output shaft and along the direction of motion of said output shaft and a sliding element adapted to slide on said resistor in consequence of the reciprocating motion of said output shaft.

6. A linear actuator comprising a magnet, a coil disposed within the magnetic field of said magnet, an output shaft mechanically connected to either of said magnet and said coil and supported by a casing so as to be linearly reciprocated in the axial direction of its own and consequently allowed to form a movable member, and coil spring means fitted between said movable member and a stationary member within said casing so as to resist the electromagnetic force generated by the interaction between the electric current fed to said coil and the magnetic field of said magnet and serving to drive said movable member in one direction of said output shaft, which linear actuator is characterized by being provided with a plurality of magnetoelectric conversion elements disposed along a line on said coil side which line is parallel to the direction of motion of said magnet relative to said coil.

* * * * *